United States Patent [19]

McGregor

[11] Patent Number: 4,526,214

[45] Date of Patent: Jul. 2, 1985

[54] BAG FILLING APPARATUS

[76] Inventor: Harold R. McGregor, 1444 Lincoln Ave., SE., Owatonna, Minn. 55060

[21] Appl. No.: 518,395

[22] Filed: Jul. 29, 1983

[51] Int. Cl.[3] ..... B65B 1/28

[52] U.S. Cl. ..... 141/59; 141/89; 141/93; 141/114; 141/314; 53/512; 53/570

[58] Field of Search ..... 141/10, 114, 313–317, 141/67, 68, 89–93, 37–66, 285–310; 53/255, 570, 573, 512, 261, 262

[56] References Cited

U.S. PATENT DOCUMENTS

| | | | |
|---|---|---|---|
| 3,851,444 | 12/1974 | Merat | 141/89 |
| 4,174,599 | 11/1979 | Callet et al. | 141/93 |
| 4,305,242 | 12/1981 | Barathé et al. | 141/314 |

*Primary Examiner*—Houston S. Bell, Jr.

*Attorney, Agent, or Firm*—Williamson, Bains, Moore & Hansen

[57] ABSTRACT

Apparatus for filling bags and simultaneously providing complete, controlled collection and discharge of dust generated from particulate material with which the bags are filled. The discharge end of a spout positioned under a hopper is formed by a pair of closure members movable between open and closed positions on which the mouth of a bag may be clamped by clamping devices movable into clamping engagement with the top, opposed faces of the bag against the outside of the spout closure members. Dust collectors are provided on the spout and are so located as to be in fluid flow communication with the interior of the top of a bag hung on the spout discharge end. Suitable conduits connect the dust collectors with a vacuum source to remove all dust generated when particulate material is discharged from the hopper, through the spout, into a bag. A flexible liner is also hung inside the spout to contain the prevent the escape of dust during bag filling operations.

18 Claims, 8 Drawing Figures

BAG FILLING APPARATUS

BACKGROUND OF THE INVENTION

This invention relates to bag filling machines of the type including a hopper from which particulate material is dispensed in predetermined quantities or batches through a spout having a discharge end on which a bag is hung for filling. Such bag filling apparatus normally includes clamps carried on the spout and movable to a clamping position to hold a bag during the filling operation. See, for example, U.S. Pat. No. 4,078,358.

The present invention is particularly directed to bag filling apparatus of the aforesaid type having a clam shell type of discharge spout under a hopper, as disclosed in U.S. Pat. No. 4,322,932, having common inventorship herewith. One of the problems encountered with respect to such bag filling and handling apparatus is the creation of dust when particulate material is dumped into a bag from a hopper, through a discharge spout. If such dust is allowed to be released to the surrounding atmosphere, it can be deleterious to the health of persons working around the bag filling machinery. This is of course particularly so if the dust is at all toxic in nature.

Suction devices for removing air or trapped gasses from the interior of bags being filled are known. One such device is disclosed in U.S. Pat. No. 2,732,988 issued on Jan. 31, 1956 to Edward Feinstein. The Feinstein patent disclosed a suction pickup nozzle mounted on a reciprocal plunger which is moved downwardly into the mouth of the bag to discharge liquid into a bag. To the best of my knowledge and belief, no satisfactory means is known or has been developed for continuously and completely removing dust formed in the top of a bag during filling with particulate material. This is particularly true with respect to the use of so-called clamshell filling spouts which have a pair of closure members which are moved towards and away from each other to open and close the spout, with bags being clamped to the outside of the closure members during filling operations. Such filling spouts present particular dust control problems for particulate material.

BRIEF SUMMARY OF THE INVENTION

This invention is directed to dust control improvements on bag filling machines of the type described above. Dust control is especially necessary and appropriate when filling bags with particulate material which could generate dust objectionable to persons working in the surrounding atmosphere. Such materials could include, for example, fertilizer, various chemical products, certain plastic material, and cement.

The bag filling machine of this invention is particularly characterized by dust control apparatus which is capable of collecting and controllably removing all of the dust generated in a bag being filled with particulate material, from the time that the bag is placed on a discharge spout, to the time that the spout is closed and the bag is removed for further handling.

This basic objective is realized by the use of dust collectors which are formed and located on the discharge end of a filling spout in such a way as to be in fluid flow communication with the interior of the upper end of the bag, especially along the side wall thereof where dust gasses tend to rise, when a bag is clamped on the discharge end of the filling spout. Conduits extend from the dust collection chambers to a vacuum source, such as a motor-driven vacuum pump to provide for the control, removal, and disposition of undesirable dust.

In a particularly advantageous form of the invention, a pair of dust collectors are mounted on opposite sides of the discharge end of a filling spout and are provided with collection ports so located as to be in direct, overlying relation to the top end of opposite side walls of a bag hung on the spout. For the filling of gusseted bags, the dust collectors will be located over the gusseted sides of the bag, directly inside of the gusseted side walls. Gusset clamps located outside of the filling spout are effectively used in combination with the aforesaid dust collectors to firmly grip the gusseted sides of the bags and to pull the bag side walls up tightly against the sides of the spout discharge end.

In a preferred embodiment of the invention each of the aforesaid dust collectors is comprised of a pair of closely spaced, generally upright wall segments which define therebetween a dust collection chamber having a collection port formed along the bottom end thereof. One of the side wall segments of each of the dust collectors preferably comprises at least a portion of one of the side walls of the discharge end of the filling spout. Where gusseted bags are being filled, external gusset clamps as described above are used to pull the gusseted sides of the bag tightly around the outside wall segment of each of the dust collectors. It is the gusseted sides of the bag which are difficult to pull tightly around the spout, and where dust is likely to escape.

As a particularly beneficial feature of the invention, a further dust collecting device is utilized in conjunction with the aforesaid dust collectors mounted on opposite sides of the spout. This supplemental dust collector is in the form of a collecting passage provided on one of the spout closure devices. Such closure devices take the form of a pair of members on the bottom end of the spout which are movable between a closed position wherein they are in closing contact with each other, and an open position wherein they are spread apart. A pair of clamping members mechanically move inwardly and outwardly to clamp the opposite faces of the upper end of a bag on the outside of the spout closure members. With this arrangement, the spout closure members will be aligned with and normally disposed in the interior of a bag hung on the spout. The dust collecting passage is preferably formed within one of the spout closure members and is disposed so as to be in fluid flow communication with the interior of the bag on the spout. A conduit also serves to connect this supplemental dust collecting passage with a vacuum source. Dust left in the top of the bag, above the level of particulate material discharged therein, after the filling spout is closed, will be collected and removed by this supplemental dust collecting passage.

Further assurance of totally dust free filling operations is provided by utilizing a flexible liner hung inside of the filling spout. The liner is suspended in confining relation to the interior of the discharge end of the spout and has an upper receiving end communicating with the bottom of the hopper. The open, discharge end of the liner is positioned adjacent the lower end of the discharge end of the spout. The liner thus serves to completely confine particulate material discharging from a hopper into a bag hung on the discharge spout.

These and other objects and advantages of the invention set forth herein will be readily understood as the following description is read in conjunction with the accompanying drawings wherein like reference numerals have been used to designate like elements throughout the several views.

DESCRIPTION OF THE PREFERRED EMBODIMENT

Figure 1:
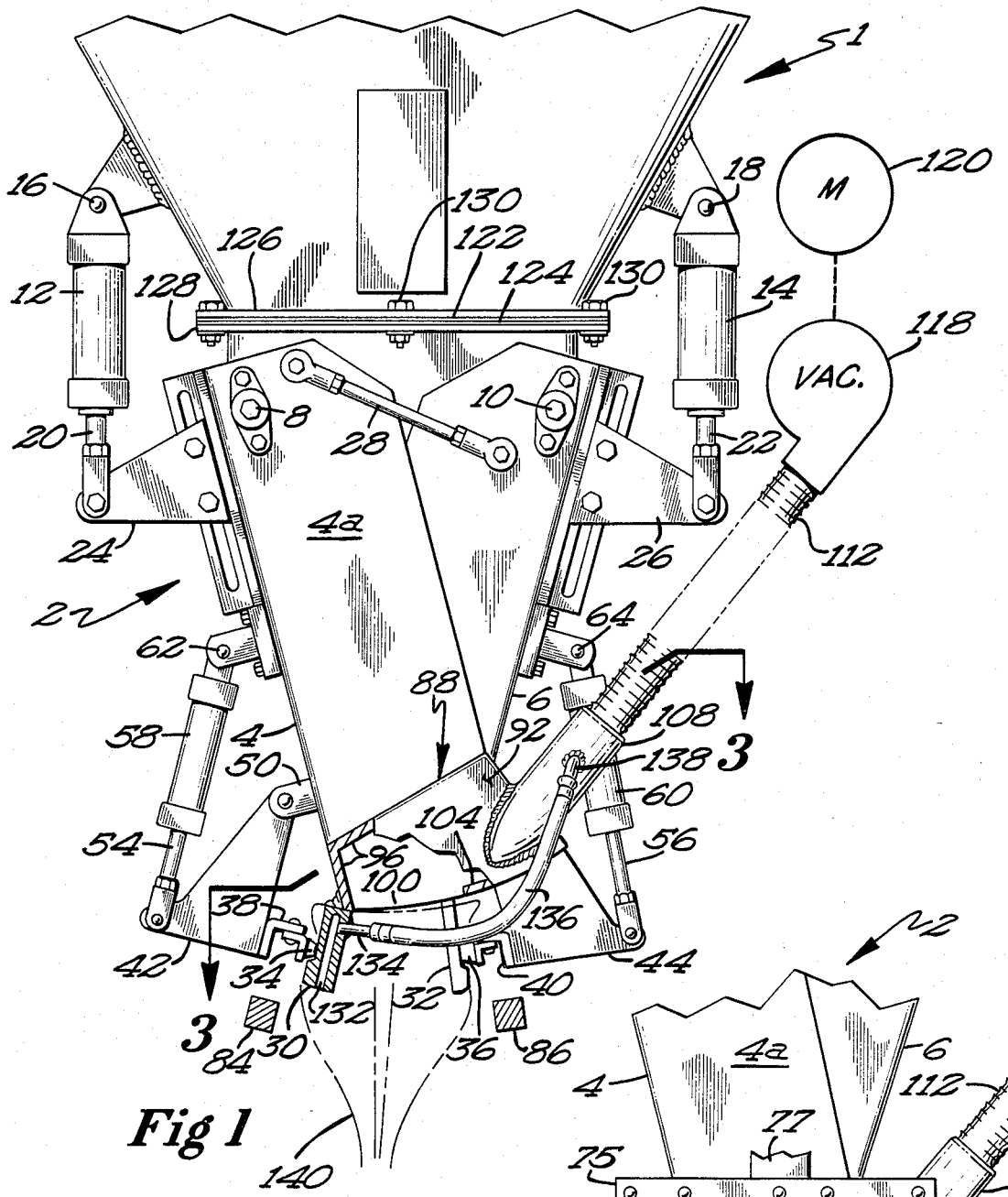
FIG. 1 is a side elevation view of the bag filling apparatus of this invention, with portions of the dust collecting structure broken away and shown in section for clarity.
Figure 2:
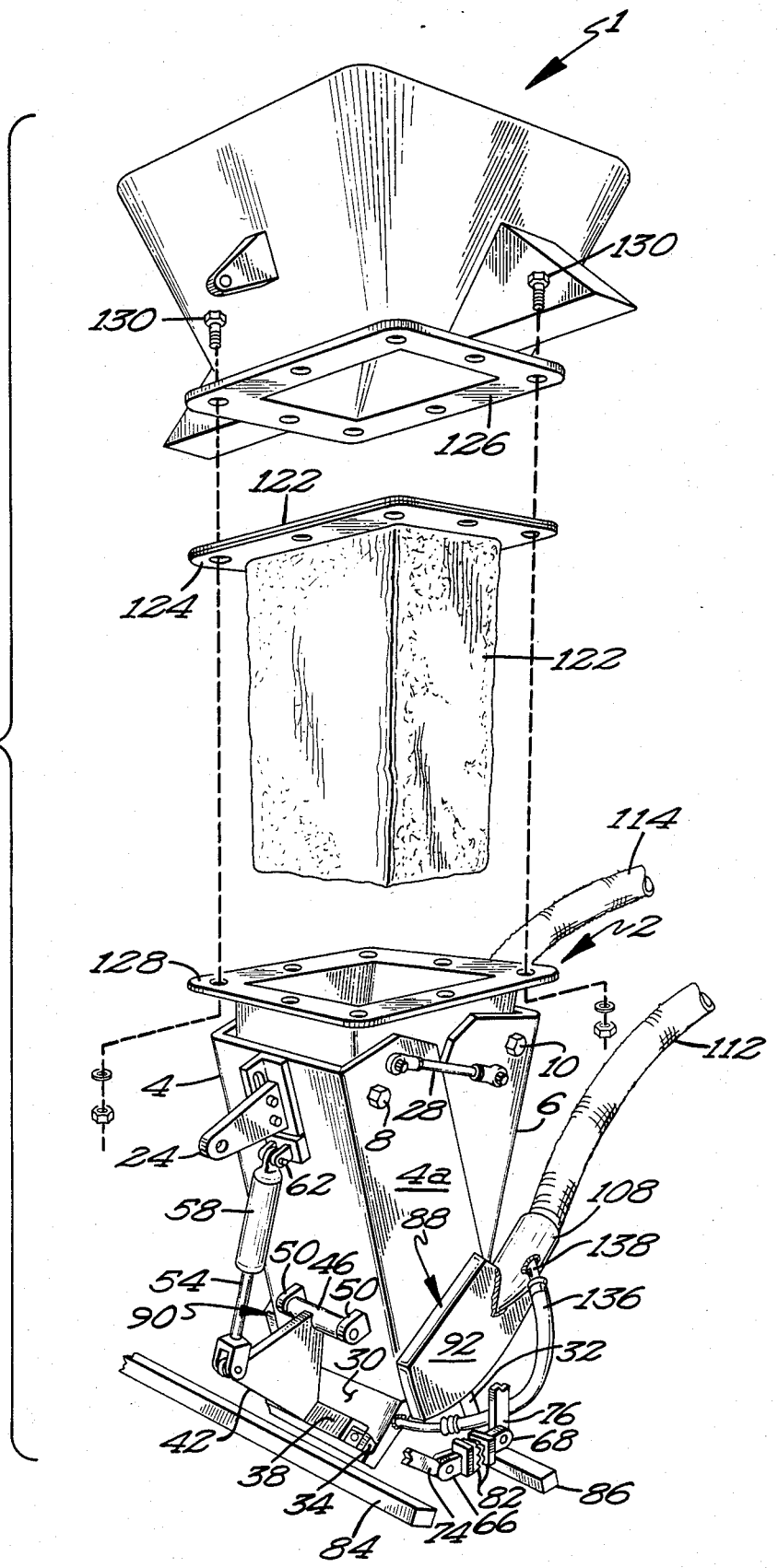
FIG. 2 is an exploded, perspective view of the bag filling apparatus of FIG. 1 showing the liner for the clamshell type of filling spout.

FIGS. 1 and 2 of the drawings illustrate bag filling apparatus of the type to which the dust collecting improvements of this invention are particularly applicable. Such bag filling apparatus includes a hopper 1 which contains particulate material and a dispensing or filling spout 2 positioned directly under the hopper to receive material therefrom. Spout 2 is preferably of the well known clamshell construction having a pair of shell halves 4 and 6 which are pivotal between open and closed positions about pivot pin connections 8 and 10 through the lower end of hopper 1. A hopper and clamshell spout assembly of such construction are described in detail in U.S. Pat. No. 4,322,932, and the disclosure in that patent is incorporated herein by reference. The structure and operation of the spout 2 will be described herein to the extent necessary to understand the mounting arrangement and function of the dust collecting improvements with respect to the dispensing spout.

Power means, preferably in the form of a pair of double acting, fluid actuated cylinders 12 and 14 are utilized to open and close clamshell spout sections 4 and 6. Cylinders 12 and 14 are attached to the lower end of hopper 1 by pivot pin connections 16 and 18 utilizing brackets as shown. Reciprocal pistons 20 and 22 of cylinders 12 and 14 are connected by linking brackets 24 and 26 to clamshell sections 4 and 6. A connecting rod 28 attached between the upper ends of the two clamshell sections assist in coordinating their pivotal movements with respect to each other. In FIG. 1, pistons 20 and 22 are retracted wherein clamshell sections 4 and 6 are swung outwardly to their open positions.

Figure 4:
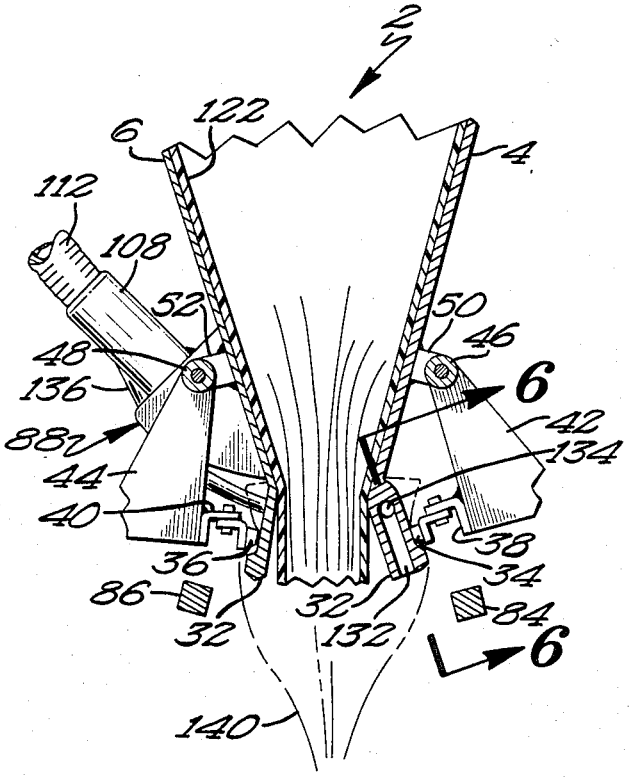
FIG. 4 is a vertical section view of the discharge end of the filler spout taken along lines 4—4 of FIG. 3.

The bottom, discharge end of spout 2 is defined by a pair of closure members movable between open and closed positions for the controlled discharge of particulate material into bags hung on the spout. The closure members preferably take the form of a pair of depending spout plates 30 and 32 attached to the lower ends of clamshell sections 4 and 6, and pivotally movable therewith from the separated open position shown in FIG. 1 to the closed position shown in FIG. 5 wherein the closure plates 30 and 32 are in abutting, closing contact with each other. Clamping means are also provided on the spout for releasably holding the opposed faces of the mouth of a bag on the spout discharge end. Such clamping means preferably comprise a pair of elongated clamping members 34 and 36 which are mechanically movable inwardly and outwardly towards and away from the spout closure plates 30 and 32 for the selective, clamping engagement of the top ends of the front and rear faces of a bag therebetween, across the width of the mouth of a bag. Bag clamps 34 and 36 are mounted on right angle bracket plates as shown, which are bolted to bracket plates 38 and 40, respectively, carried on connecting arms 42 and 44. Connecting arms 42 and 44 are pivotally attached to the outside faces of clamshell sections 4 and 6 by pivot pins 46 and 48 mounted between bracket ears 50 and 52 as shown in FIGS. 1, 4, and 6. Connecting arms 42 and 44 are further attached at their outer ends to pistons 54 and 56 of a pair of double acting, power cylinders 58 and 60, pivotally connected at pivot point attachments 62 and 64 to clamshell sections 4 and 6. The extension of pistons 54 and 56 operates through connecting arms 42 and 44 to fling bag clamps 34 and 36 inwardly into clamping engagement with a bag mouth against the outside faces of spout closure plates 30 and 36 as shown in FIGS. 1 and 4. The retraction of pistons 54 and 56 pivots connecting arms 52 and 54 upwardly and outwardly to move bag clamps 34 and 36 outwardly away from spout closure plates 30 and 32 to bag release positions.

Figure 8:
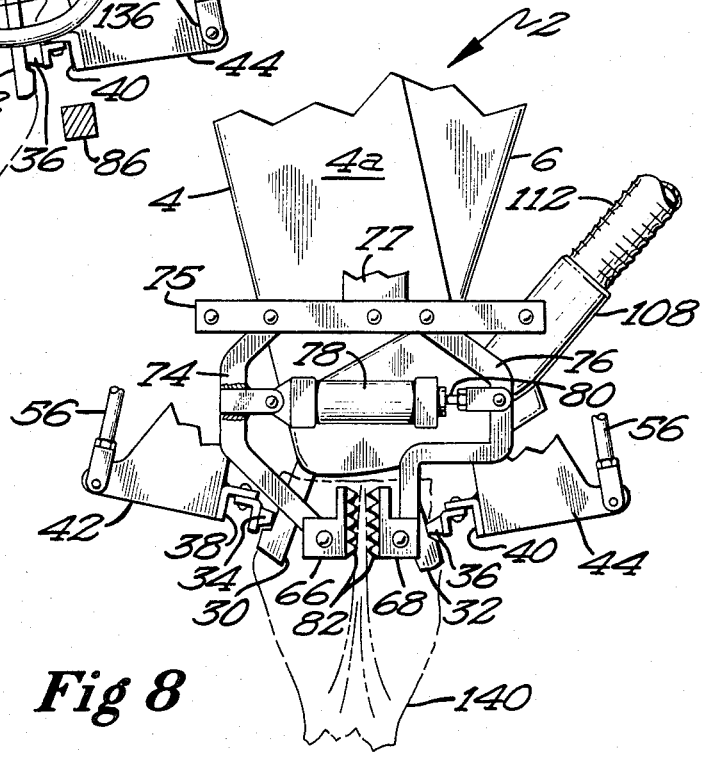
FIG. 8 is a fragmentary, side elevation view of the filler spout showing one of the gusset clamping assemblies.
Figure 3:
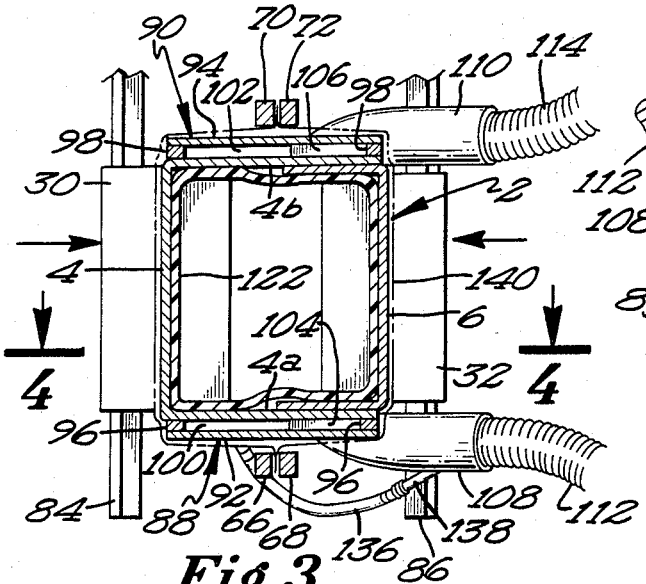
FIG. 3 is a section view taken along lines 3—3 of FIG. 1 and providing a top view of the dust collectors and discharge end of the filler spout.

For the purpose of forming and handling gusseted bags, including those of the pinch bottom type, during bag filling operations, additional bag clamping devices are provided. Such gusset clamps are designated by reference numerals 66, 68, and 70, 72, and are shown in their support positions on opposite sides of the discharge end of spout 2 in FIGS. 2, 3, and 8. Each of the pairs of gusset clamps 66, 68, and 70, 72 are identical and are movably supported by overhead support structure (not shown) on opposite sides of filling spout 2. The actuating and carrying mechanism for gusset clamps 66 and 68 is shown in FIGS. 8 and 2. Clamps 66 and 68 are carried on the bottom ends of a pair of arms 74 and 76 pivotally mounted as shown on a crossbar 75 suspended by member 97 from an overhead support structure (not shown). The overhead support structure includes a power actuated, carriage mechanism whereby the gusset arm assemblies on each side of spout 2 may be moved laterally, towards and away from the sides of the spout 2 between remote, rest positions and gusset gripping positions closely adjacent the side spout 2 as illustrated in FIGS. 2, 3, and 8. A double-acting, power cylinder 78 and its reciprocal piston 80 are connected between pivotal arms 74 and 76 as shown in FIG. 8. The extension and retraction of piston 80 swings arms 74 and 76 inwardly and outwardly so as to pivot gusset clamps 66 and 68 between the gusset clamping position shown in FIG. 8, and a separated, gusset release position. The extension of piston 80 from the retracted position shown in FIG. 8 will serve to swing gusset clamps 66 and 68 apart to their release position. Rubber teeth 82, as shown in FIG. 8, may be used on the gusset clamps to assist in the gripping of the gussets of a bag.

For purposes of forming and handling bags in the course of filling operations, the apparatus may also include a pair of parallel forming bars 84 and 86 shown most clearly in FIG. 2 and also illustrated in FIGS. 1, 3, 4, and 5. Forming bars 84 and 86 are utilized to grip the upper end of a bag, after it has been filled, and while it is still clamped on the filling spout 2. These bars serve to controllably lower a filled bag onto a laterally moving conveyor on which the bag is transported, as it is held by the forming bars, to a bag closing station. For this purpose, forming bars 84 and 86 are pivotally supported on a carriage assembly in such a way that they may be moved towards and away from each other to selectively grip and release a bag neck. The carriage assembly is also movable laterally as well as up and down, so that the bars 84 and 86 may controllably support a bag as it is lowered onto a horizontal conveyor and then moved laterally to a bag closing station. Since the carriage assembly and mounting arrangement for the forming bars forms no particular part of this invention, it is not disclosed herein in detail. That apparatus is fully disclosed in issued U.S. Pat. No. 4,322,932, the disclosure of which is incorporated herein by reference, particularly with respect to the support structure and operation of the forming bars 84 and 86.

The dust collecting devices utilized on the above-described hopper and spout assembly comprise a combination of dust confining and controlled collecting elements. These elements include dust collecting ports on the discharge end of spout 2, as well as a liner suspended within the spout. The liner is designated by reference numeral 122 and is hereinafter described.

The dust collectors are located so as to be in fluid flow communication with the interior of a bag at the top thereof, when a bag is clamped on the discharge end of spout 2. Two of such dust collectors are indicated generally by reference numerals 88 and 90. Although the dust collectors may be formed in various ways, it has been found that a dust collecting chamber can be effectively constructed by utilizing a pair of closely spaced, generally upright wall segments which define therebetween a dust collection chamber. The two dust collectors 88 and 90 are located as shown on opposite sides of the discharge end of spout 2. The wall segments which form the dust collecting chambers comprise at least a lower portion of the side walls 4*a* and 4*b* of clamshell segment 4. Outer plates 92 and 94 are welded into position outside of wall segments 4*a* and 4*b* in closely spaced relation thereto, against spacer bars 96 and 98. In this way, dust collecting chambers are formed on opposite sides of the discharge end of spout 2 between the pairs of parallel wall segments 92, 4*a*, and 94, 4*b*. The bottoms of these dust collecting chambers are open, and face downwardly to provide collection ports 100 and 102. The above-described dust collecting structures may best be understood by reference to FIGS. 1, 2, and 3. As is indicated most clearly in FIGS. 1 and 3, the bottom edge or spacer walls 104 and 106 of each of the dust collectors 88 and 90 terminate in spaced apart relation to the opposite end of the dust collecting chambers to define the extent of dust ports 100 and 102. It is to be noted that the bottom edges of dust collectors 88 and 90 are of arcuate shape and conform to the arcuate bottom edges of clamshell segments 4 and 6. This arrangement ensures that the dust collectors will closely cover the spaces along the opposite sides of spout 2 where the sides of a bar are held, as hereinafter set forth. The generally vertically extending dust collectors 88 and 90 are oriented generally perpendicular. to the direction of extent of elongated bag clamps 34 and 36 and spout closure members 30 and 32.

Each of the dust collectors 88 and 90 is connected to a vacuum source. For that purpose, conduit connector stubs 108 and 110 are connected to the chambers formed within dust collectors 88 and 90 and extend outwardly therefrom as illustrated in FIGS. 1, 2, and 3. These connector stubs are in turn connected to flexible vacuum hoses 112 and 114 which communicate with a vacuum pump 118 driven by a motor 120. Vacuum pump 118 may be arranged to discharge into a suitable dust collecting receptacle.

In order to ensure controlled confinement of dust generated during bag filling operations, a tubular liner 122 is suspended within discharge spout 2. Liner 122 may be made of any suitable, flexible material, such as plastic sheeting. For example, plastic material sold under the trade name Naugahyde would be a suitable material. Liner 122 is of generally tubular shape and is affixed at its upper periphery around the top face of a mounting ring 124. Ring 124 may be fiber or cardboard material, and is apertured as shown in FIG. 2. Liner 122 is suspended within discharge spout 2 by resting mounting ring 124 on top of flange 128 formed on the top end of discharge spout 2. Ring 124 is sandwiched between flange 128 and a mating flange 126 formed on the bottom end of hopper 1. Flanges 126 and 128 are apertured as shown in FIG. 2 for the insertion of bolts 130 therethrough which tightly sandwich the top periphery of liner 122 and mounting ring 124 between the two flanges. In this way, liner 122 is sealingly secured at its upper receiving end around the lower periphery of hopper 1. Liner 122 is suspended in the aforesaid manner inside of discharge spout 2 in confining relation to the interior of discharge end thereof, and thus inside of movable closure members 30 and 32 as shown in FIG. 4. The open discharge end of liner 122 will thus be adjacent the lower extremity of the discharge end of spout 2.

For reasons hereinafter set forth with respect to the operation of the dust collecting system, a further dust collecting device is utilized on the bottom end of discharge spout 2. This device takes the form of a dust collecting passage on one of the spout closure members 30 or 32. The dust collecting passage is provided on closure member 30 and is indicated by reference numeral 132 in FIGS. 1, 4, 5, and 6. Although passage 132 may be formed in various ways on the bottom of spout 2, a preferred approach is to form passage 132 internally, within closure plate member 30. For this purpose, closure member 30 is of double walled, platelike construction as illustrated in the aforesaid figures. The two, parallel walls of closure member 30 define dust collecting passage 132 therebetween. The bottom end of passage 132 is open and faces downwardly for fluid flow communication with the interior of a bag hung on spout 2. Spout closure members 30 and 32 are elongated in a direction extending across the width of the faces of a bag hung on the spout discharge end as appears most clearly in FIG. 3. Thus, dust collecting passage 132 will extend across the entire width of closure member 30. Dust collecting passage or chamber 132 is also connected to a vacuum source, preferably to the same vacuum pump 118 to which dust collectors 88 and 90 are connected. For this purpose, a stub tubing connector 134 is attached to closure member 30 in flow communication with passage 132, and is in turn connected to a flexible vacuum line 136. Vacuum line 136 is attached at its opposite end to connector stub 108 by means of a short length of connector tubing 138. A vacuum may thus be drawn on passage 132 through vacuum hose 112, stub connector 108 and interconnecting vacuum line 136.

In operation, a bag to be filled will be hung on the bottom end of filler spout 2 in order to receive particulate material from hopper 1 through the spout. FIGS. 1 and 4 show a bag 140 so positioned. The opposed front and rear faces of bag 140 are pulled up over the outside of spout closure plates 30 and 32 as indicated in phantom lines. Bag clamps 34 and 36 are shown in FIGS. 1 and 4 in clamping engagement with the outside of closure members 30 and 32 so as to hold the top end of bag 140 therebetween. With bag 140 so positioned, dust collecting passage 132 will have its bottom, open end disposed across one of the bag faces immediately adjacent thereto. As is indicated in FIG. 6, passage 132 extends across the entire width of closure member 130, and thus will traverse the face of a bag 140 supported thereon by bag clamp 34. It is to be noted that spout closure members 30 and 32 will be aligned with the interior of bag 140 and will project into the inside of the bag mouth as shown in FIGS. 1 and 4. Passage 132 will thus be properly located to collect dust rising within the upper end of bag 140.

Figure 7:
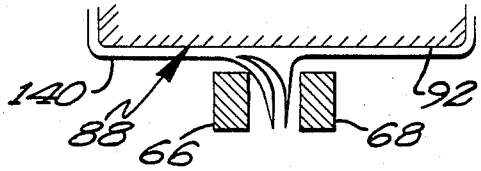
FIG. 7 is a fragmentary, top plan view of one side of the discharge spout as shown in FIG. 3, and particularly illustrating the clamping of one gusseted side of a bag around the discharge spout.

It will be readily understood that granular or particulate material will often generate dust when being dumped into a bag 140 from hopper 1, through discharge spout 2. The dust will rise within the bag, most normally along the bag walls. Accordingly, dust collectors 88 and 90 are so located on the opposite sides of spout 2 as described above that their collection ports 100 and 102 will open downwardly in direct, overlying relation to the top end of the side walls of the bag. Ports 100 and 102 will be in fluid flow communication with the interior space of the bag immediately inside of the bag side walls. When a gusseted bag is being filled, gusset clamps 66, 68, and 70, 72 will grip and hold the gusset pleats of the bag as indicated in FIGS. 3, 7, and 8. The gusset clamps are moved inwardly toward each other for this clamping action by means of power cylinder 78. As this is done, the gusset clamps will serve to firmly grip the side walls of the bag and to pull the bag side walls up tightly against the outside faces of the opposite sides of the discharge end of spout 2. As viewed in FIG. 3, the gusseted sides of bag 140 will be drawn tightly by the gusset clamps against the outside surfaces of dust collector wall segments 92 and 94. Thus, collecting ports 100 and 102 will be disposed in direct, overlying relation to the bag spaces immediately inside of the gusseted side walls of the bag to collect dust rising along those side walls. With vacuum pump 118 in operation, the dust so collected will be evacuated to an appropriate collection receptacle.

Liner 122 serves a very important purpose in preventing the escape of dust to the surrounding atmosphere. Clamshell sections 4 and 6 of the spout 2 overlap each other in the manner indicated in FIGS. 1 and 3. Dust rising from the open bag mouth in the course of a filling operation could continue to rise up within the discharge spout, inside of clamshell sections 4 and 6, above the top of the bag and escape along the unsealed seams where the clamshell sections overlap and contact each other. Such escape of dust is precluded by liner 122, which extends over the entire vertical length of spout 2 from its upper receiving end at thehottom of hopper 1 to the lower extremity of spout 2, substantially even with the bottom ends of spout closing members 30 and 32.

Figure 5:
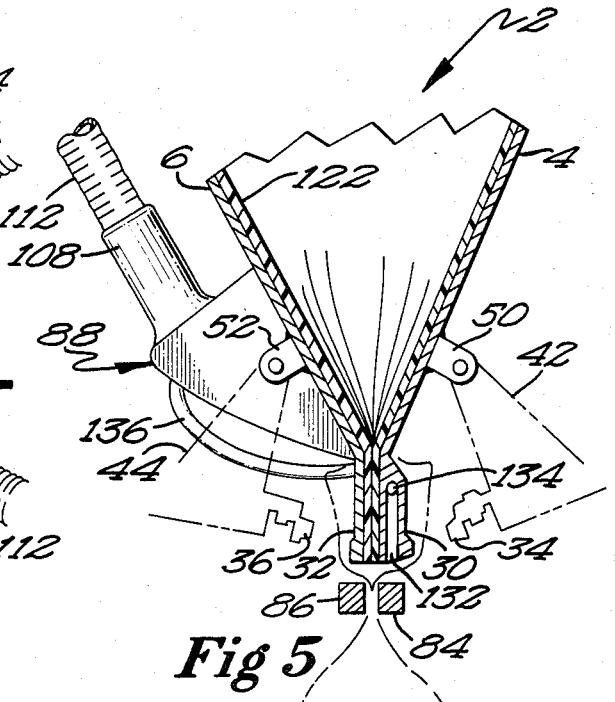
FIG. 5 is a vertical section view taken at the same location on FIG. 3 as is FIG. 4 but showing the discharge end of the spout closed with a bag hung on the spout.
Figure 6:
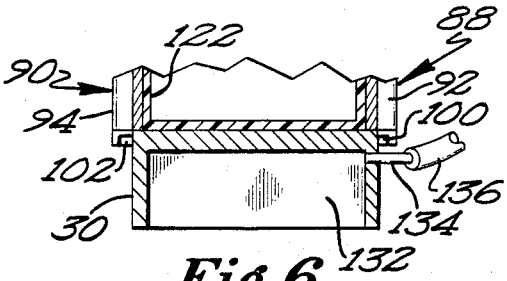
FIG. 6 is a fragmentary, section view taken along lines 6—6 of FIG. 4 and showing detail of a dust collection passage.

FIG. 5 shows the spout closure members 30 and 32 moved into closing contact with each other after a bag 140 has been filled. Normally, a bag will be filled with particulate material to a level below the top of the bag, thus leaving an air space between the top of the fill and the top of the bag, within the bag mouth. Before the bag is released from the spout, forming bars 84 and 86 are moved into embracing juxtaposition to the bag, and thence pinched inwardly towards each other to the positions shown in FIG. 5 wherein they grip the bag neck. This movement of the forming bars is described in detail in the above-referenced U.S. Pat. No. 4,322,932. When the forming bars 84 and 86 grip the bag neck, prior to its release from the spout, as indicated in FIG. 5, they cause the air, and any entrained dust, in the bag mouth to be compressed and forced upwardly. With the spout members 30 and 32 closed at this time, the gusseted ends of the bag will be substantially flattened in a closed position and will not be extended as when the spout is open as shown in FIG. 4. Thus, dust collectors 88 and 90 will not be effective at this time to draw a vacuum on the interior bag and remove dust forced upwardly by the squeezing action of bars 84 and 86. Supplemental, dust collecting passage 132 comes into particular play at this time to prevent the escape of dust from the bag mouth, especially from the end spaces of the bag between the gusset points and the adjacent side walls of spout 2. Since closure member 30 and its dust collection passage 132 are disposed inside of the top end of the bag before it is released, any dust forced upwardly in the bag by the squeezing action of forming bars 84 and 86 will be drawn into passage 132 and evacuated by the suction action of vacuum pump 118.

Those skilled in the art will readily appreciate that the dust collection devices disclosed herein will effectively operate to preclude the escape of dust from the top end of a bag being filled. Each of the dust containing and control devices, including dust collectors 88, 90, spout liner 122 and supplemental dust collecting passage 132 operate to assist in collecting and controllably removing dust generated from a bag mouth during filling operations with particulate material. The combination of these three dust control elements is especially effective in substantially completely eliminating the escape of dust to the surrounding atmosphere.

Bags may be placed on and removed from the discharge end of spout 2 either manually or mechanically. A fully automated system for mechanically placing bags one at a time at the discharge end of a spout and removing the bags after they are filled, and transporting them to a closing station are disclosed in the aforesaid U.S. Pat. No. 4,322,932.

It is anticipated that various changes may be made in the size, shape, and arrangement of the parts and components of the dust collecting and bag filling apparatus disclosed herein without departing from the spirit and scope of the invention as defined by the following claims:

What is claimed is:

1. Apparatus for filling bags comprising:

hopper means for containing particulate material to be discharged into bags;

a spout positioned to receive particulate material from said hopper, said spout having a discharge end defined by closure members movable between open and closed positions for the controlled discharge of particulate material into bags hung on said spout wherein said spout closure members comprise a pair of rigid closure devices on the bottom end of said spout movable between a closed position wherein they are in closing contact with each other and an open position wherein they are spaced apart;

clamp means on said spout for releasably holding opposed faces of the mouth of a bag on said spout discharge end wherein said clamp means comprises a pair of clamping members mechanically movable inwardly and outwardly towards and away from said spout closure devices for selective clamping engagement of the top ends of the opposite faces of a bag therebetween, with the opposite faces of the bag held against the outside of said pair of spout closure devices by respective ones of said pair of clamping members, whereby said spout closure devices will be aligned with the interior of a bag hung on the spout;

a dust collector on at least one side of said spout discharge end having a collection port so location as to be in direct, overlying relation to the top end of one side wall of a bag hung on said spout, with said port in fluid flow communication with the interior space of a bag immediately inside of said one side wall thereof;

a generally tubular liner made of flexible material suspended inside of said spout in confining relation to the interior of said discharge end and said movable closure members, said liner having an upper receiving end communicating with said hopper and an open discharge end adjacent the discharge end of said spout, whereby said liner is so constructed and arranged as to confine particulate material discharging from said hopper and prevent the escape of dust to the surrounding atmosphere even when said movable closure members are open; and conduit means connected to said port for fluid flow communication with a vacuum source.

2. Apparatus for filling bags as defined in claim 1, and further including:

a second dust collector on the opposite side of said spout discharge end having a collection port so located as to be in direct, overlying relation to the top end of the opposite side wall of a bag hung on said spout, with said port in fluid flow communication with the interior space of said bag immediately inside of said opposite side wall thereof.

3. Apparatus for filling and handling bags as defined in claim 2 wherein:

said clamp means comprises a pair of elongated clamping members mechanically movable inwardly and outwardly towards and away from said spout closure members for selective clamping engagement of the top ends of the front and rear faces of a bag therebetween, along the width of the bag.

4. Apparatus for filling bags as defined in claim 3 wherein:

said dust collectors are located adjacent spout side walls on opposite sides of said spout and are oriented generally perpendicular to said elongated clamping members.

5. Apparatus for filling bags as defined in claim 3 and further including:

additional clamping devices positioned adjacent to said one side and said opposite side of said spout discharge end and movably operative to clamp said bag side walls tightly around and against said spout sides.

6. Apparatus for filling bags as defined in claim 5 wherein:

said additional clamping devices comprise first and second pairs of gusset clamps positioned adjacent to said one side and said opposite side of said spout discharge end, each of said pairs of gusset clamps being mechanically movable towards and away from each other in a gusset clamping and release path extending generally between the front and rear walls of a gusseted bag to clamp gusset pleats along said bag side walls, as the bag is being filled, said gusset clamps being positioned outside of the bag so as to firmly grip the bag and pull the bag side walls up tightly against said sides of said spout discharge end.

7. Apparatus for filling bags as defined in claim 6 wherein:

said dust collectors are located next to said one side and said opposite side of said spout discharge end with said collection ports in direct, overlying relation to the bag spaces inside of said gusseted side walls of the bag.

8. Apparatus for filling bags as defined in claim 4 wherein:

each of said dust collectors is comprised of a pair of closely spaced, generally upright wall segments defining therebetween a dust collection chamber, and said collection ports are formed along the bottom ends of said chambers and open downwardly into the top of a bag hung on said spout.

9. Apparatus for filling bags as defined in claim 8 wherein:

one of said wall segments of each of said dust collectors comprises at least a portion of one side wall of said spout.

10. Apparatus for filling bags as defined in claim 1 wherein:

said liner is sealingly secured at said upper receiving end thereof around the lower periphery of said hopper.

11. Apparatus for filling bags as defined in claim 10 wherein:

the upper peripheral edge of said liner is securely sandwiched between mating flanges on the bottom end of said hopper and on the upper end of said spout.

12. Apparatus for filling bags as defined in claim 1 wherein:

said spout closure devices are of elongated shape in a direction extending across the width of the faces of a bag hung on said spout discharge end; and said dust collecting passage is formed inside of said one spout closure device.

13. Apparatus for filling bags as defined in claim 1, and further including:

a pair of bag gripping and forming bars movable under said spout in a position of embracing juxtaposition to the top end of a bag hung on said spout for filling, at a location below the top of the bag and above the level of particulate material discharged into the bag from said hopper, said forming bars being further movable towards and away from each other for bag gripping and release, whereby dust forced upwardly inside of a filled bag in response to the bag gripping action of said forming bars will be collected and controllably discharged through said dust collecting passage.

14. Apparatus for filling bags comprising:

hopper means for containing particulate material to be discharged into bags;

a spout positioned to receive particulate material from said hopper, said spout having a discharge end designated by closure means movable between open and closed positions for the controlled discharge of particulate material into bags hung on said spout wherein said spout closure means comprises a pair of rigid closure devices on the bottom end of said spout movable between a closed position wherein they are in closing contact with each other and an open position wherein they are spread apart;

clamp means on said spout for releasably holding opposed faces of the mouth of a bag on said spout discharge end;

dust collector means on said spout discharge end having inlet means so located as to be in fluid flow communication with the top interior space of a bag hung on said spout discharge end for filling; and a flexible tubular liner suspended inside of said spout in confining relation to the interior of said discharge end and said movable closure members, said liner having an upper receiving end communicating with said hopper and an open discharge end adjacent the discharge end of said spout, whereby said liner is so constructed and arranged as to confine particulate material discharging from said hopper and prevent the escape of dust from said particulate material to the surrounding atmosphere even when said movable closure means is in its open position.

15. Apparatus for filling bags as defined in claim 14 wherein:

said liner is sealingly secured at said upper receiving end thereof around the lower periphery of said hopper.

16. Apparatus for filling bags as defined in claim 14 wherein:

said dust collector means comprises a pair of dust collectors on opposite sides of said spout discharge end, each of said dust collectors having a collection port so located as to be in direct, overlying relation to the top end of one side wall of a bag hung on said spout, with said ports in fluid flow communication with the interior space of a bag immediately inside of said side walls; and conduit means connected between each of said dust collectors and a vacuum source.

17. Apparatus for filling bags as defined in claim 14 wherein:

said clamp means comprises a pair of clamping members mechanically movable inwardly and outwardly toward and away from said spout closure devices for selective, clamping engagement of the top ends of the opposite faces of a bag therebetween, with the opposite faces of the bag held against the outside of said pair of spout closure devices by respective ones of said pair of clamping members, whereby said spout closure devices would be aligned with the interior of a bag hung on the spout;

a dust collecting passage on one of said spout closure devices disposed so as to be in fluid flow communication with the interior of a bag hung on said spout discharge end; and conduit means connected between said dust collecting passage and a vacuum source.

18. Apparatus for filling bags as defined in claim 17 said spout closure devices are elongated in a direction extending across the width of the faces of a bag hung on said spout discharge end; and said dust collecting passage is formed inside of said one spout closure device.

* * * * *